US005519430A

United States Patent [19]

De Cock et al.

[11] Patent Number: 5,519,430

[45] Date of Patent: May 21, 1996

[54] LED RECORDING HEAD INCLUDING A CARRIER STRIP WITH SPACED MODULE CARRIERS

[75] Inventors: Etienne M. De Cock; Lucien A. De Schamphelaere, both of Edegem; Alfons J. Grobben, Heverlee, all of Belgium

[73] Assignee: Xeikon NV, Mortsel, Belgium

[21] Appl. No.: 255,608

[22] Filed: Jun. 8, 1994

[51] Int. Cl.[6] ..... B41J 2/45; B41J 2/435

[52] U.S. Cl. ..... 347/238; 347/245

[58] Field of Search ..... 347/245, 238, 347/130, 138

[56] References Cited

U.S. PATENT DOCUMENTS

| | | | |
|---|---|---|---|
| 4,536,778 | 8/1985 | De Schamphelaere et al. | 347/130 |
| 4,821,051 | 4/1989 | Hediger | 347/130 |
| 4,856,168 | 1/1990 | Newman et al. | 347/238 |
| 5,014,074 | 5/1991 | Dody et al. | 347/238 |

FOREIGN PATENT DOCUMENTS

| | | |
|---|---|---|
| 0464948 | 1/1992 | European Pat. Off. . |
| 4129146 | 3/1993 | Germany . |

*Primary Examiner*—Benjamin R. Fuller
*Assistant Examiner*—David Yockey
*Attorney, Agent, or Firm*—Brumbaugh, Graves, Donohue & Raymond

[57] ABSTRACT

A recording head is described having mounted thereon M modules, each module comprising an array of N LEDs and associated drivers. The recording head comprises a carrier bar, and a carrier strip fixedly and electroconductively and thermoconductively secured to a surface of the carrier bar. The carrier strip comprises along one side thereof M spaced individual module carriers connected with the rest of said carrier strip by means of at least one frangible zone. M LED dies and associated driver module dies are fixedly secured to the surface of said M module carriers, each die containing an array of N linearly arranged LEDs. The array of N LEDs of each die overlaps the space between the spaced individual module carriers in order to come in abutting relationship with the end or ends of neighboring N LED arrays. In said LED array a module carrier on which a defective module is present can be replaced without damaging the adjacent modules.

13 Claims, 5 Drawing Sheets

LED RECORDING HEAD INCLUDING A CARRIER STRIP WITH SPACED MODULE CARRIERS

CROSS-REFERENCE TO CO-PENDING APPLICATIONS

A number of features of the printers described herein are the subject matter of:

co-pending U.S. patent application Ser. No. 08/257,112, now U.S. Pat. No. 5,455,668 entitled "Electrostatographic single-pass multiple-station printer for forming an image on a web", co-pending U.S. patent application Ser. No. 08/257,270 entitled "Recording Module", co-pending U.S. patent application Ser. No 08/257,119 entitled "Non-impact printer with evenness control", and co-pending U.S. patent application Ser. No. 08/255,609 entitled "Temperature controlled LED recording head", all filed on even date herewith.

1. Field of the Invention

This invention is concerned with an LED recording head comprising light emitting diodes (LEDs) particularly suited for use in electrophotographic printers. The growing trend in office printing, graphic arts applications and short run printing has resulted in a great deal of research efforts being carried out in the field of electrophotographic printers. Notwithstanding the relatively complicated printing process, requiring a relatively large number of steps, the electrophotographic process excels as a consequence of its high speed, high resolution and the possibility to implement color, making it a prime process for printing high quality color work.

2. Background of the Invention

At present, more and more use is made of LED arrays at the exposure station of electrophotographic printers taking advantage of the fact that LED exposure stations have no moving parts and that no complicated optics are required, such as in the case of laser printers. The use of LED arrays has a particular advantage over the use of lasers in that positional accuracy, especially important in multi-station printers where two or more images have to be superimposed in exact registration, is easier to achieve. Moreover, LED arrays are available at a sufficiently high packing density, say 600 and even more LEDs per inch, so that the necessary conditions for high resolution printing are fulfilled.

For example, printing along the width of a paper of 8.5×11 inches, will require a recording head having at least 8.5×600 =5100 LEDs at 600 dpi resolution and which have to be selectively energized as a function of the data to be recorded. It would not be possible to mount so many LEDs on a single LED die. Therefore, a chosen number of LEDs, typically 128 LEDs, are mounted on a single LED die.

An array of more, in general N, LEDs with their associated drivers is referred to hereinafter as a module. An appropriate number M of these modules is used to make up an LED array.

The process of recording evolves in a line by line fashion so that at the end of recording a page, an electrostatic latent image is formed on a pre-charged photoconductive drum or belt, which becomes image-wise discharged by the light emitted by the LEDs. This latent image is subsequently rendered visible by means of toner in a dry or liquid developing process. Subsequently the toner image is transferred to a final carrier, e.g. a sheet of paper, paper web, film or an aluminium printing plate and fixed at the surface thereof. Meanwhile, the photoconductive drum or belt is again brought to a rechargeable condition and cleaned in order to undergo a subsequent recording cycle.

The nature of the photoconductive belt or drum and the processing steps form no part of this invention and examples thereof are well known in the art. The exposure with LEDs however, has a specific character and poses special problems.

In order to expose a picture element of one line, energizing of an individual LED is required. The presence of an individual LED and/or its driver which either does not function at all or has a light output which is either too low or too high translates into a line of no density or as a line of too low or too high density in the direction of the moving paper.

Due to the high cost of LED printing arrays it is desirable that a defective LED can be replaced by one conforming to the tolerances of the printing cycle.

At present single separate modules, each on their own module carrier are produced first. The production of such modules requires accurate positioning of LED and driver dies on the module carriers. These modules have to be tested for possible defects. Subsequently these modules have to be assembled with very high positional accuracy into a complete LED writing array. After assembling, a further testing is necessary to find out if additional defects were introduced. After assembling of such an array the replacement of a defective module becomes very difficult to perform without damaging adjacent non-defective modules (see e.g. EP 115 088).

It is an object of the present invention to provide a recording head comprising an LED array in which a defective module can be replaced without damaging adjacent non-defective modules.

It is a further object of the present invention to provide a recording head that can be constructed in fewer and less complicated production steps.

SUMMARY OF THE INVENTION

According to the invention, there is provided a recording head having mounted thereon M modules, each module comprising an array of N LEDs and associated drivers, the recording head comprising:

a carrier bar a carrier strip fixedly and electroconductively and thermoconductively mounted on a first surface of said carrier bar, said carrier strip being partitioned along one side thereof into M spaced individual module carriers, said M spaced individual module carriers remaining connected with the rest of said carrier strip by means of at least one frangible zone; and M LED dies and associated driver dies fixedly and thermoconductively and electroconductively mounted on the surface of said M module carriers, each die containing an array of N linearly arranged LEDs whereby said array of N LEDs of each die overlaps the space between said M spaced individual module carriers in order to come in abutting relationship with the end or ends of a neighboring N LED array or arrays.

The recording head according to the invention presents the advantage of not requiring the assembly of single separate modules on individual module carriers, which carriers thereafter have to be mounted on a carrier bar with very high positional accuracy.

In the recording head according to the invention the mounting and alignment of the modules are carried out directly on the carrier bar via a common carrier strip. Moreover, the provision of a frangible zone allows to replace a defective module by simply lifting the module carrier which rotates around the frangible zone without damaging the adjacently positioned modules.

In a preferred embodiment the carrier bar is provided with a longitudinally extending groove in a first surface and the M spaced individual module carriers extend with their end edge remote from the frangible zone over said longitudinally extending groove.

Alternatively, the end of the module carrier remote from the frangible zone forms an undercut angle with said first surface of said carrier bar.

In order to obtain said frangible zone, the material of the carrier strip between the module carriers and the remaining part of said carrier strip has a reduced mechanical strength. According to one embodiment the reduction of said mechanical strength is obtained e.g. by cutting a void or according to another embodiment by punching some of the material in the zone between said module carriers and the remaining part of said carrier strip.

In a preferred embodiment the carrier bar has a second surface which may be fixedly and thermo-conductively mounted to a cooling body in order to carry away heat generated by the LEDs when the recording head is in operation. In the case of a wide format, high resolution recording head, it is advantageous to provide at least one channel in the cooling body through which cooling medium, e.g. water or other suited liquid may flow.

The already mentioned first surface of the carrier bar may be made sufficiently large so that interconnection printed circuit boards (PCBs) for controlling the LEDs may also be mounted thereon.

Most preferably the recording head may also be provided with optical means for focusing the light emitted by the LEDs. Preferably, the optical means is in the form of an array of focusing fibres co-extending with the LED arrays along the length of the carrier bar (see U.S. Pat. No. 4905021 dealing with a rod lens array).

The frangible zones connecting the spaced individual module carriers with the rest of the carrier strip may be formed by a plurality of T-shaped cuttings through the carrier strip, the leg of each T extending from the side of the carrier strip and the arms of the Ts extending longitudinally of the strip, substantially in line with each other and spaced from each other by a short distance. The material of the carrier strip located in this short distance spacing between the arms of the Ts constitutes the frangible zone. The T-form cutting may be carried out with the help of laser cutting, spark erosion or other method known in the art. Other forms of cuttings, such as an L-form, may also be applied.

The materials of which the carrier bar, the carrier strip and the cooling body are formed are preferably equal in terms of thermal expansion and should show good electrical and thermal conductivity. In a preferred embodiment of the carrier bar and the carrier strip, this material may be provided with a corrosion inhibiting coating, for example of nickel and gold to ensure good electrical connection between the LED modules and the module carrier on one hand and the carrier strip and the carrier bar on the other hand. The gold layer on the carrier strip is essential for a good wire bonding between the module carriers, the interconnection PCBs and the drivers. The provision of such a coating layer is preferably carried out by electrolysis, chemical deposition, plasma deposition or other method known in the art.

PREFERRED EMBODIMENTS OF THE INVENTION

The invention will now be further described, purely by way of example, by reference to the accompanying drawings in which.

Figure 4:
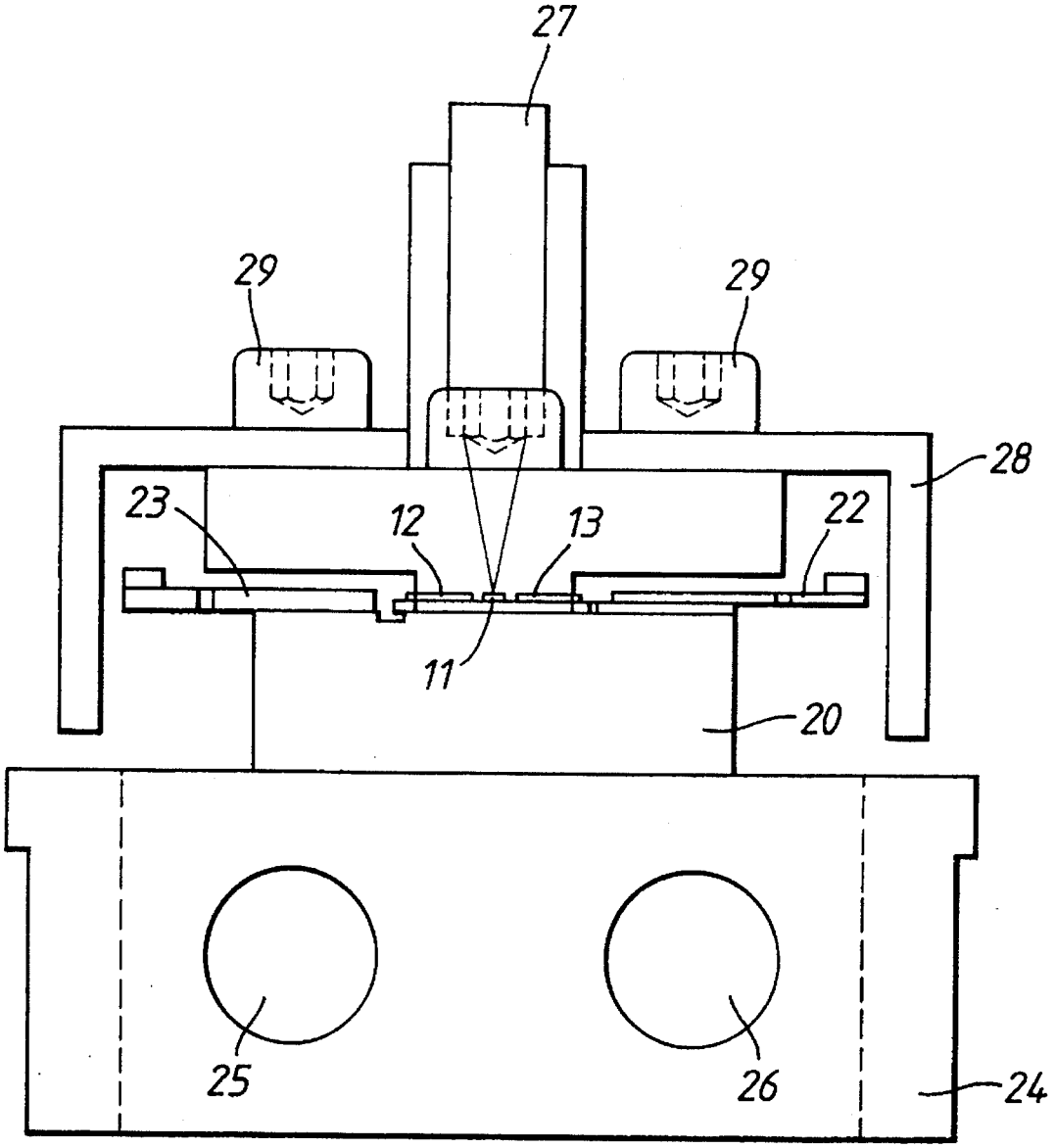
Figure 5A:
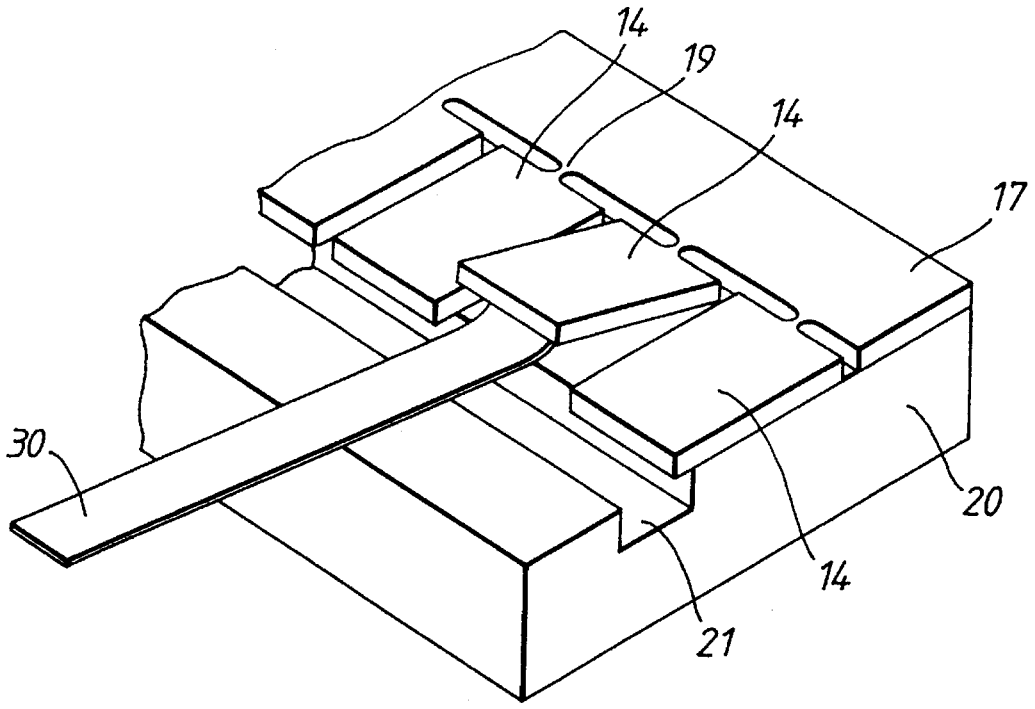
Figure 5B:
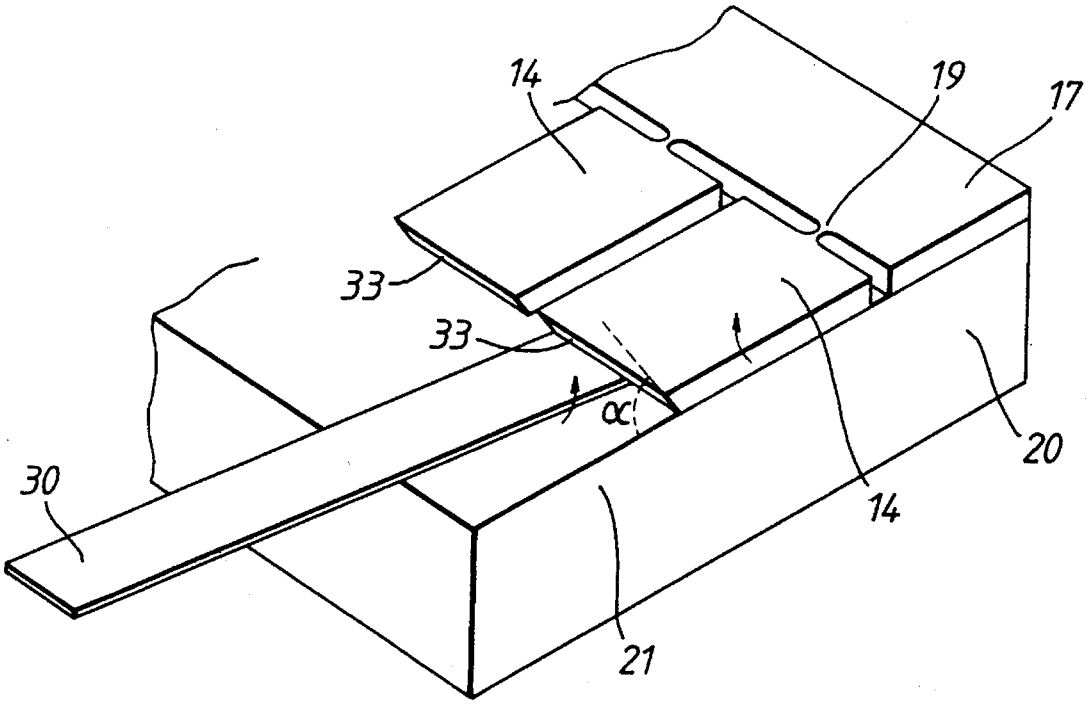
Figure 6:
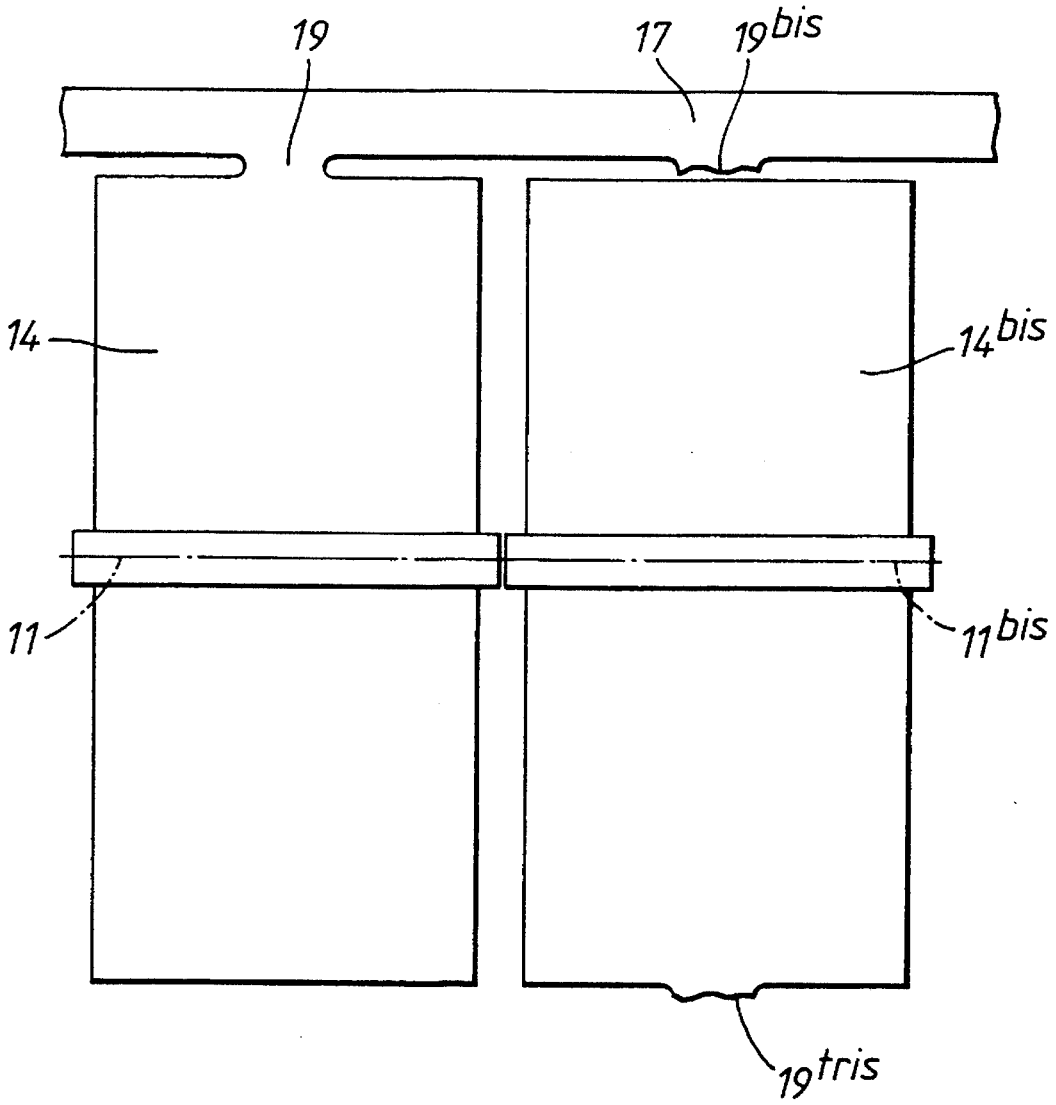

FIG. 4 gives a cross-sectional view of an LED printing head;

FIG. 5*a* shows how a module carrier, carrying a defective LED can be removed from the LED-array;

FIG. 5*b* shows another possibility to remove a defective module carrier; and FIG. 6 shows in top view how a defective module carrier is replaced.

Figure 1:
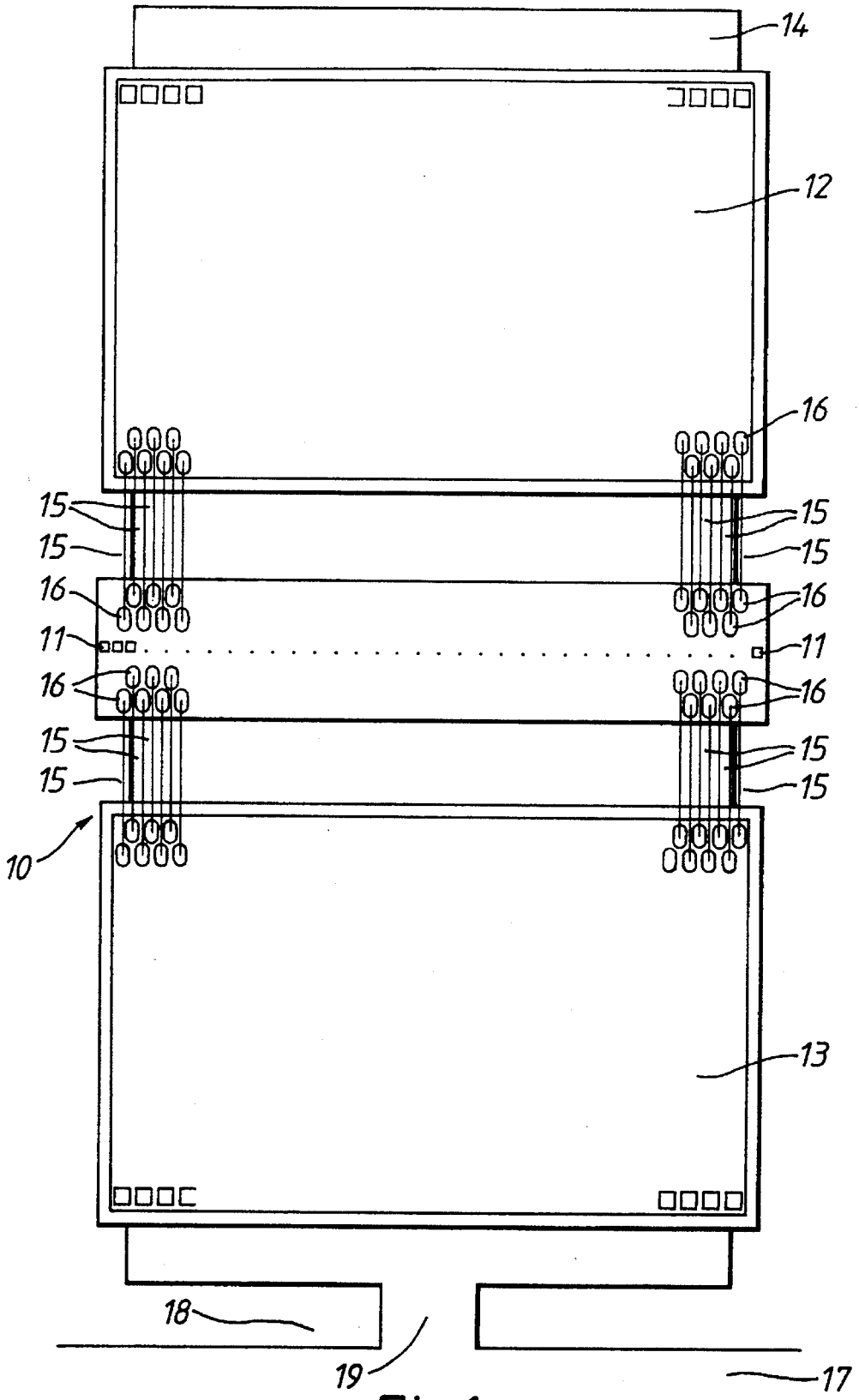
FIG. 1 is a top view (magnified) of a module comprising an LED-array and its associated drivers, mounted on a module carrier.

As may be derived from FIG. 1 a module 10 of an LED-array comprises N arranged LEDs 11 and associated drivers 12 and 13 symmetrically mounted on a module carrier 14.

In the embodiment shown, the module 10 carries 128 LEDs arranged in a substantially linear fashion.

Two drivers 12 and 13 are provided, driver 12 driving e.g. the odd numbered LEDs, while driver 13 driving the even numbered LEDs.

The drivers 12 and 13 are connected with the LEDs by means of wire bonding, materialized by wires 15 and bonding pads 16.

The module carrier 14 is linked to a remaining part 17 of the carrier strip 40 by means of a frangible zone 19.

Figure 2:
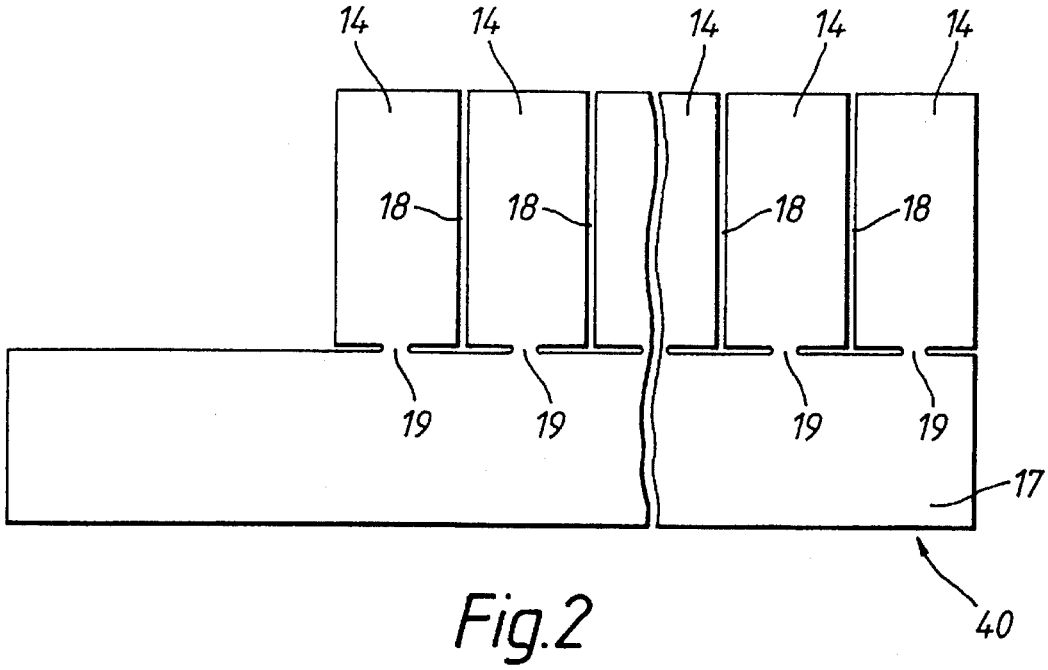
FIG. 2 is a detail showing the structure of the carrier strip.

In the embodiment as illustrated, the frangible zone 19 is formed by a small piece of material linking the module carrier 14 with the remaining part 17 of the carrier strip 40 (see FIG. 2).

The edges of the N LED arrays extend over the edges of the module carrier 14 for the purpose of coinciding with the edges of another LED array when a recording head of substantial length has to be manufactured.

In the embodiment as illustrated in FIG. 1, the module carrier 14 carries 128 LEDs and associated drivers 12 and 13, but the number of LEDs may be chosen at will. Preferably, however, the number of LEDs on one module shall be a number corresponding with a power of two. So, module-carriers 14 carry e.g. 64 , 128 or 256 LEDs.

As may be derived from FIG. 2, the module carriers 14 are connected to the remaining part 17 of the carrier strip 40 via a small frangible zone 19, the voids 18 having a T-shaped form. The voids 18 extend through the carrier strip 40. The voids 18 may be formed by e.g. spark erosion, chemical milling or any other technique known in the art. The carrier strip 40 is connected to the carrier bar 20 (see FIG. 3) by means of thermally and electroconductively conducting glue. Alternative forms of the voids 18, such as L-shaped ones may also be used, if desired. According to an alternative the frangible zone may be formed by a V-shaped groove running between the individual module carriers 14 and the rest of the carrier strip 17.

Figure 3:
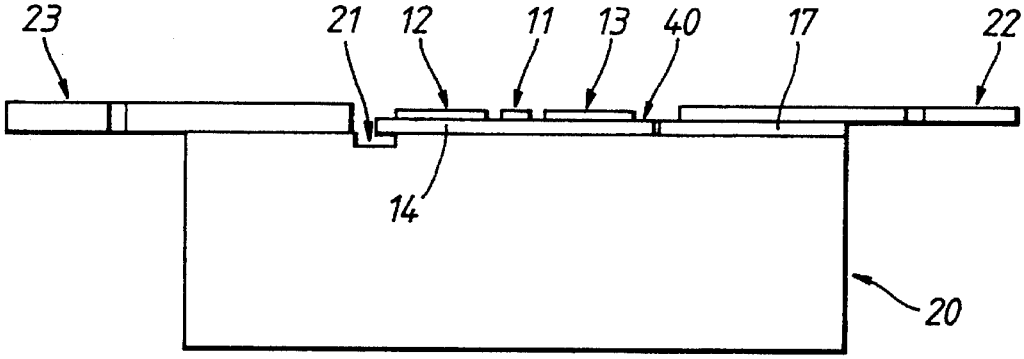
FIG. 3 is a view showing the structure of the module carriers and interconnection PCBs mounted on a carrier bar.

In FIG. 3, a cross sectional view of a partly assembled LED array is shown.

The carrier strip 40 (the module carriers 14 and the remaining part 17) is mounted on the upper surface of a carrier bar 20 by means of e.g. electroconductive and thermoconductive glue (not shown) so that the heat produced by the LED array 11 during operation is dissipated by the carrier bar 20. Also the interconnection Printed Circuit Boards (PCBs) 22, resp. 23 are mounted on the carrier bar 20.

The carrier bar 20 is also provided with a longitudinally extending groove 21 over which protrudes a part of the module carriers 14 for purposes as explained further on (see FIG. 5*a*). The carrier strip 40 is preferably made of copper or brass onto which a supplementary layer of nickel and gold is provided. This layer may be built-up by techniques known in the art, such as vapour deposition, electrolytic plating, etc.

FIG. 4 shows a cross-sectional view of a completed LED array. Like reference numerals as in FIG. 3 refer to the same parts as illustrated therein.

Provided is a support or cooling body 24 fixedly secured to carrier bar 20.

Cooling body 24, if desired, can be provided with longitudinally extending channels 25 and 26 through which a cooling liquid can flow. Although a number of cooling liquids may serve the purpose, water is used preferably. It will be clear to the skilled worker that the carrier bar 20 and the cooling body 24 may be formed in one piece.

Co-extending with the LED arrays 11, there may be provided an array of auto-focusing fibres 27 in order to focus the light emitted by the LEDs.

A cap 28 for fixedly securing the array of auto-focusing fibres 27 to the carrier bar 20, carrying the LED arrays 11 is provided. The cap 28 is fixed by means of screws 29.

FIG. 5*a* shows how a module carrier 14, carrying the drivers 12 and 13 and the LED array 11 (not shown) is removed from the remaining part of the carrier strip 17 in case a defective module is present in the recording head.

To this end a small lever 30, the width of which being smaller than the width of the module carrier 14 is put in the longitudinally extending groove 21. By a small downwardly directed movement the module carrier 14 in question is lifted, causing the zone 19 of less resistance to break. In this way, the broken-off module carrier 14 can be taken away from the assembled LED array. Glue remaining on the place where the module carrier 14 was taken away from the carrier bar 20 can be removed with the help of a small suction device after scraping the glue off or by partly dissolving it in a suitable solvent. In so doing, the location where the defective module and its module carrier 14 are removed is free to receive another module carrier with a module showing no defects.

In FIG. 5*b*, which relates to an alternative embodiment of how to remove a module carrier 14, shows module carriers with a front surface 33 forming an acute angle $\alpha$ with the carrier bar 20 are used. Without need of the groove 21 (see FIG. 5*a*) a small lever 30 can be used to remove a module carrier 14 carrying a defective module.

FIG. 6 shows in top view how the replacement of a module carrier 14 can be carried out. In the space left by a removed module carrier 14 a layer of glue (not shown) is again provided, so that a new module carrier 14bis can be inserted. On the place where the defective module was broken off, a small residue 19bis remains, which is sufficiently small to still provide a clearing of, say 100 to 150 microns when mounting another module carrier. The new module carrier 14bis is taken from a similarly constructed strip but is rotated through 180° so that the broken edges of the new module carrier 14bis are not adjacent the residue 19bis which remains on the rest of the carrier strip 17. After aligning the new LED array 11bis with its neighbouring arrays 11, the glue is given time to set. The freshly mounted module carrier 14bis is then wire bonded to its associated PCB (not shown).

The new module carrier 14bis is taken from a spare carrier strip 40, on which modules serving as a kind of substitute modules are provided. So, the modules 14bis also show a small portion 19tris where they were broken away. By turning them over 180 degrees, ample space is provided for mounting them without difficulty in the space left by the module 14 which had to be replaced.

The LED array according to the invention is particularly suited for use in an electrophotographic printer, operating e.g. at a resolution of 600 dpi. In the case where 128 LEDs per module are used, a 600 dpi resolution requires a pitch between the centers of two adjacently positioned modules of 5.4186 mm as derived from the calculation 25.4 mm×128/600.

We claim:

1. A recording head comprising:

a carrier bar; and a carrier strip thermoconductively and electroconductively mounted to a first surface of said carrier bar, said carrier strip comprising:

a plurality of spaced module carriers positioned along one side of said carrier bar;

a remaining part of said carrier strip positioned along a second side of said carrier bar; and a plurality of frangible zones linking a first end of each of said spaced module carriers to said remaining part of said carrier strip, each of said spaced module carriers comprising:

a surface and a plurality of edges, an array of linearly arranged LEDs thermoconductively and electroconductively mounted on the surface, said array extending over the edges for abutting with an LED array of an adjacent module carrier, and associated drivers thermoconductively and electroconductively mounted on the surface, said drivers being electrically connected with said array of linearly arranged LEDs.

2. A recording head according to claim 1, wherein said carrier bar is provided with a longitudinally extending groove in said first surface of said carrier bar, the second end of each of said spaced module carriers extending over said longitudinally extending groove.

3. A recording head according to claim 1, wherein the said second end of each of said spaced modular carriers forms an undercut angle with said first surface of said carrier bar.

4. A recording head according to claim 1, wherein said carrier bar has a second surface which is fixedly and thermoconductively mounted to a cooling body for carrying away heat when said recording head is in operation.

5. A recording head according to claim 4, wherein said cooling body is provided with at least one channel through which a cooling medium can flow.

6. A recording head according to claim 1, wherein said carrier bar also carries interconnection printed circuit boards connected to said drivers.

7. A recording head according to claim 1, wherein said recording head further comprises optical means for focusing the light emitted by said LEDs.

8. A recording head according to claim 7, wherein said optical means comprises an array of focusing fibres co-extending with said LED array.

9. A recording head according to claim 1, wherein said frangible zone is formed by a plurality of T-shaped cuttings through said carrier strip.

10. A recording head according to claim 1, wherein said carrier bar, said carrier strip and said cooling body are formed of electrically and thermally conductive material.

11. A recording head according to claim 10, wherein said material is selected from copper, brass and aluminium.

12. A recording head according to claim 10, wherein said carrier bar and said carrier strip are provided with a corrosion resistant coating for improving thermal and electrical conductivity.

13. A recording head according to claim 12, wherein said coating comprises gold.

* * * * *

UNITED STATES PATENT AND TRADEMARK OFFICE

CERTIFICATE OF CORRECTION

PATENT NO. : 5,519,430

DATED : May 21, 1996

INVENTOR(S) : De Cock et al.

It is certified that error appears in the above-indentified patent and that said Letters Patent is hereby corrected as shown below:

Title page, following Item 22, insert:
--[30] Foreign Application Priority Data
June 18, 1993 European Pat. Off. 93304769.8--;

Title page, Item 56, 5th line, "4,856,168" should read --4,896,168--.

Signed and Sealed this

Twenty-second Day of October, 1996

Bruce Lehman

*Attest:*

BRUCE LEHMAN

*Attesting Officer*

*Commissioner of Patents and Trademarks*